United States Patent [19]

Luke

[11] Patent Number: 4,476,882

[45] Date of Patent: Oct. 16, 1984

[54] TOBACCO SMOKE FILTERS

[75] Inventor: John A. Luke, Hampshire, England

[73] Assignee: Brown & Williamson Tobacco Corporation, Louisville, Ky.

[21] Appl. No.: 464,310

[22] Filed: Feb. 7, 1983

[51] Int. Cl.[3] ..... A24D 3/04

[52] U.S. Cl. ..... 131/336; 131/361

[58] Field of Search ..... 131/361, 336, 339, 340, 131/209, 198 R, 198 A

[56] References Cited

U.S. PATENT DOCUMENTS 4,135,523 1/1979 Luke et al. ..... 131/209

4,273,141 6/1981 Van Tilburg ..... 131/339

*Primary Examiner*—V. Millin

*Attorney, Agent, or Firm*—Charles G. Lamb

[57] ABSTRACT

A smoke filter for a smoking article (e.g. a cigarette) comprises a filter plug having an airflow duct whose floor extends along the filter plug from the mouth end of the plug such that the end of the duct remote from the mouth end is deeper than the end of the duct at the mouth end, with a region of progressively decreasing depth from the deep end towards the shallow end. The at least one duct may comprise a plurality of grooves equiangularly spaced around the periphery of the filter plug, in which case it is possible for the grooves to extend helically and to be divided into sets of opposite hand such that each groove of one set intersects several grooves of the other set. Alternatively, the airflow duct may comprise a single annular groove extending around the filter plug with a shallower side at the mouth end of the plug and a deeper side remote from the mouth end, in which case a relatively stiff tipping is required. In all cases the tipping includes ventilation perforations communicating with the deeper end of the air duct.

20 Claims, 4 Drawing Figures

TOBACCO SMOKE FILTERS

DESCRIPTION

This invention relates to tobacco smoke filters for use with smoking articles, cigarettes for example.

It is well known to provide filter-tipped cigarettes with ventilation means which permit the ingress of ventilation air into the filter. A purpose of this is to effect a decrease in the mainstream delivery of smoke components. It has been observed that when ventilation air flows into a filter comprising a plug of fibrous filtration material, cellulose acetate for example, through a ventilation zone extending around the filter the tobacco smoke is caused to pass out of the filter in an axial stream having a diameter less than the diameter of the end face of the filter plug. This comparatively narrow stream of smoke impinges on a limited area of the taste receptors in the mouth of the smoker. It is an object of the present invention to provide a tobacco smoke filter in the use of which there occurs a stimulation of the taste receptors over a wider region in the smoker's mouth.

The present invention provides a smoke filter including a rod-like plug of filtration material and having at least one airflow duct at the periphery of said plug, wherein said at least one airflow duct has an outlet opening at the mouth end of said plug and an inlet opening spaced from the mouth end, and wherein said at least one airflow duct has a region in which the depth progressively decreases along the airflow duct in a direction towards the mouth end of the plug.

Conveniently, said at least one airflow duct has its region of decreasing depth extending substantially up to the mouth end of the plug. Preferably there may be several said airflow ducts, each defined partly by a respective one of a plurality of grooves in the peripheral surface of the filter plug, and partly by the inwardly facing surface of wrapping means around the filter plug. In this case the width of the grooves may be constant or it may increase or decrease in the direction towards the mouth end of the filter plug.

In order that the invention may be clearly understood and readily carried into effect, reference will now be made, by way of example, to the diagrammatic drawing hereof, in which.

Figure 1:
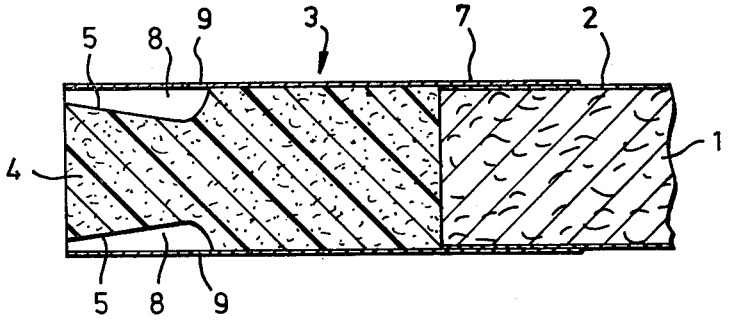
FIG. 1 shows a part view, in axial section, of a filter tipped cigarette.

The cigarette of FIG. 1 comprises a rod 1 of cut tobacco enwrapped in cigarette paper 2, and a filter 3 comprising a self-sustaining filter plug 4 of fibrous cellulose acetate filtration material. At the periphery of the plug 4 there extend a number, eight as shown, of parallel, axially extending grooves 5—see also FIG. 2. As may be seen from FIG. 1, the grooves 5, which extend from the mouth end of the plug 4 for a distance less than the full length of the plug, are so formed that the depth of each decreases towards and substantially up to the mouth end of the plug. A convenient method of forming the grooves 5 is to subject the plug 4, or preferably a filter rod length from which the plug was cut, to a hot-moulding process such as, for example, that disclosed in United Kingdom Patent Specification No. 1,507,765, using suitably shaped forming means. The surfaces of the grooves 5 may be rendered impervious.

Serving to secure the filter 3 to the cigarette rod 1, 2 is a tipping 7 which, in the portions where it overlies the grooves 5, defines, together with the walls of the grooves 5, airflow ducts 8. A row of ventilation perforations 9, shown in exaggerated form, in the tipping 7 encircles the plug 4 at a location overlying the upstream end of the grooves 5, the arrangement being such that there is in communication with each of the airflow ducts 8 at least one of the perforations 9.

When the cigarette of FIG. 1 is smoked, ambient air is drawn through the ventilation perforations 9 into the airflow ducts 8. The air passes along the airflow ducts 8 to the outlet ends thereof unmixed, or substantially unmixed, with tobacco smoke. Since the depth of the grooves 5 partly defining the airflow ducts 8 decreases in the direction of flow of the ventilation air along the ducts 8, the air exits the ducts 8 into the smoker's mouth with a component of velocity directed radially outwardly. There is thus provided a divergent air stream which entrains smoke issuing from the mouth end of the filter plug 4 by a Coanda effect and so causes the smoke to come into contact with taste receptors over a comparatively wide region of the smoker's mouth. This is perceived by the smoker as an enhanced smoke character.

Figure 3:
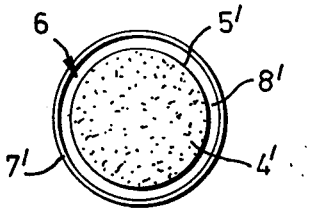
FIG. 3 shows a mouth-end view of a filter of a somewhat different form from the filter shown in FIG. 1.

The filter, a mouth-end view of which is shown in FIG. 3, comprises a plug 4' which, instead of being provided with a number of longitudinally extending peripheral grooves, comprises a single annular circumferential groove 5'. In axial section of the plug 4', the groove 5' has a contour similar to the contour of the base of each of the grooves 5 of the plug 4 of FIG. 1. A stiff wrapper sleeve or mouthpiece 7', which may be formed of plastics material, encases the plug 4' and receives an end portion of a cigarette rod in a manner analogous with the tipping 7 of the cigarette shown in FIG. 1. The sleeve 7' requires to be stiff in order that the annular mouth-end opening, designated 6, of airflow duct 8', defined by the circumferential annular groove 5' and the sleeve 7', remains open when the filter is in use.

Figure 2:
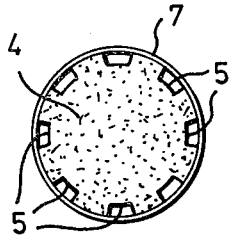
FIG. 2 shows a mouth-end view of the filter of the cigarette of FIG. 1.

The effect produced by the filter of FIG. 3 is similar to that of the filter 3 of FIGS. 1 and 2. Ambient air is drawn into the airflow duct 8' through perforations (not shown) in the wrapper or mouthpiece 7' and, because of the contour of the groove 5', the air enters the smoker's mouth as a divergent stream which serves to cause smoke to impinge on an extended region of taste receptors.

Figure 4:
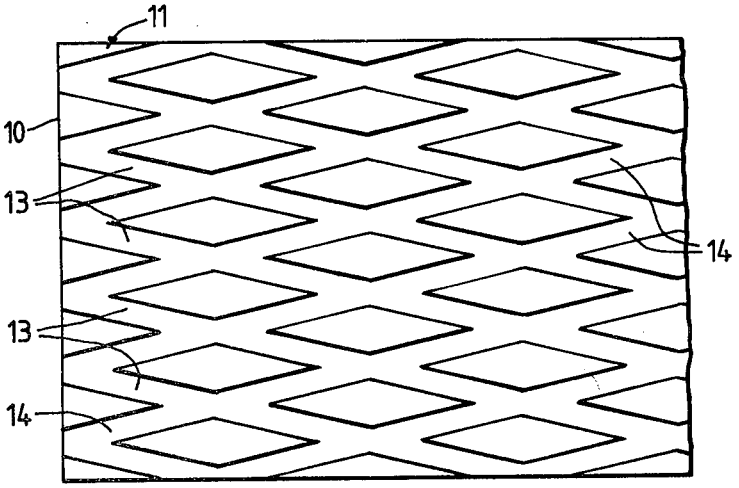
FIG. 4 shows a development view of a portion of the peripheral surface of a filter plug of another form.

FIG. 4 shows, as a development view, a pattern of peripheral grooves which may be utilized as an alternative to the axially extending grooves 5 of the filter of FIG. 1 or the single annular circumferential groove 5' of the filter of FIG. 3. In FIG. 4 reference numeral 10 denotes the mouth end of a filter plug 11. A first series has peripheral, parallel grooves 13 extending at a small angle to the axis of the plug 11 and the grooves 14 of a second, similar series extend at substantially the same angle to the axis but with opposite hand. That is, the first and second series of grooves 13 and 14, respectively, are helical grooves twisting about the periphery of the filter plug 11 in opposite rotational directions from each other. For example, the first series of grooves 13 have a left hand or counter-clockwise turn when viewed from the mouth end 10 of the filter plug 11, and the second series of grooves 14 have a right hand or clockwise turn when viewed from the mouth end 10 of the filter plug 11. The two sets of grooves 13, 14 intersect to produce a reticular formation. As with the single series of grooves 5, each of the grooves 13, 14 has a region of decreasing depth in the direction towards and substantially up to the mouth end 10 of the plug 11. In use the plug 11 is overwrapped by a wrapper (not shown) permitting ventilation air to flow into the grooves 13, 14 at upstream locations thereof and a smoke-spreading effect is achieved similar to that exhibited by the previously described filters.

The wrapping means for the filter plug may comprise a plug wrapper of pervious nature on the plug exterior and a longer tipping of impervious nature overlying the plug wrapper and securing the filter plug to the tobacco rod 2. In this case the ventilation perforations need only be present in the impervious tipping.

The filter plug may, if desired, be formed as two sub-plugs one of which has the grooves 5, 13, 14 or the single circumferential groove 5' therein, the other sub-plug being plain.

If desired, the ventilation perforations may comprise a micro-perforated region of the tipping.

I claim:

1. In a smoke filter including:

(a) rod-like filter plug means of filtration material having a mouth end;

(b) airflow duct means at the periphery of said filter plug means; and (c) means defining an outlet opening of said airflow duct means at the mouth end of said filter plug means and an inlet opening spaced from the mouth end;

the improvement wherein:

(d) said airflow duct means has a region in which said airflow duct means has a depth, measured radially of the filter plug means, which progressively decreases along the airflow duct means in a direction towards said mouth end of the filter plug means.

2. A filter according to claim 1, and further including wrapping means enwrapping said filter plug means and means adapted to permit the ingress of ambient air into said airflow duct means, said airflow duct means having a part which is remote from said mouth end of said filter plug means and is adapted to receive said ambient air ingress permitted by said wrapping means.

3. A filter according to claim 2, wherein said airflow duct means comprises several said airflow ducts; wherein said wrapping means has an inwardly facing surface contiguous with said filter plug means; and wherein said filter plug means has a plurality of longitudinal peripheral grooves corresponding to said several airflow ducts, each said airflow duct being defined partly by a respective one of said grooves and partly by the inwardly facing surface of the wrapping means.

4. A filter according to claim 3, wherein each of said grooves has a constant width.

5. A filter according to claim 3, wherein each of said grooves has a width which increases in a direction towards said mouth end of the filter plug means.

6. A filter according to claim 3, wherein each said groove has a floor surface which is impervious to air.

7. A filter according to claim 6, wherein each said groove has side surfaces which are impervious to air.

8. A filter according to claim 2, wherein said wrapping means includes ventilation perforation means to permit said ingress of air into said part of the airflow duct means.

9. A filter according to claim 8, wherein said ventilation perforation means comprise a micro-perforated region in the wrapping means.

10. A filter according to claim 2, wherein said wrapping means includes:

(i) an inner layer of air-pervious material;

(ii) an outer layer which is less pervious to air; and (iii) ventilation perforation means in said less pervious outer layer to permit ingress of air into said part of said airflow duct means.

11. A filter according to claim 1, wherein said region of progressively decreasing depth of said airflow duct means continues substantially to said mouth end of the filter plug means.

12. In a smoke filter including:

(a) rod-like filter plug means of filtration material having a mouth end;

(b) airflow duct means at the periphery of said filter plug means; and (c) means defining an outlet opening of said airflow duct means at the mouth end of said filter plug means and an inlet opening spaced from the mouth end;

the improvement wherein:

(d) said airflow duct means comprise first and second sets of helical airflow ducts around said filter plug means;

(e) said filter plug means includes first and second sets of helical grooves extending peripherally thereof with said first set of grooves corresponding to said first set of airflow ducts and being of a first hand, and said second set of grooves corresponding to said second set of airflow ducts and being of opposite hand, whereby at least one of the grooves of said first set intersects several of the grooves of said second set;

(f) each of said grooves of each of said first and second sets has an inlet end and an outlet end with said outlet end nearer to said mouth end of the filter plug means; and (g) each of said grooves of each of said first and second sets has a region which has a depth progressively reducing along a direction from said inlet end towards said outlet end thereof.

13. A filter according to claim 12, wherein said region of progressively reducing depth of each said groove continues substantially to said mouth end of the filter plug means.

14. A filter according to claim 12, and further including wrapping means enwrapping said filter plug means, and means adapted to permit the ingress of ambient air through said wrapping means to the grooves of said first and second sets, each of said grooves having a part thereof which is remote from said mouth end of said filter plug means and is in register with said ingress-permitting means of the wrapping means.

15. A filter according to claim 12, wherein each said groove has a floor surface and side surfaces, and said floor and side surfaces are impervious to air.

16. In a smoke filter including:

(a) rod-like filter plug means of filtration material having a mouth end;

(b) wrapping means enwrapping said filter plug means and having an inner surface contiguous with said filter plug means;

(c) airflow duct means between the exterior of said filter plug means and said wrapping means; and (d) means defining an outlet opening of said airflow duct means at the mouth end of said filter plug means and an inlet opening spaced from the mouth end;

the improvement wherein:

(e) said airflow duct means comprise an annular groove extending around said filter plug means and having first and second sides, said first side being at said mouth end of said filter plug means and having a depth which is greater than the depth of said second side which is spaced from the mouth end of said filter plug means; and (f) said annular groove includes a region in which the depth of the groove progressively reduces in a direction extending transversely of said groove from said second side towards said first side thereof.

17. A filter according to claim 16, wherein said wrapping means comprise a relatively stiff outer sleeve around and encasing said filter plug means, said sleeve terminating at the mouth end of said filter plug means; wherein said means defining an outlet opening of said airflow duct means comprise means defining a clearance between the exterior of the filter plug means and said inner surface of said sleeve; and wherein said sleeve includes ventilation perforation means disposed therearound and overlying said second side of said annular groove and adapted to communicate with said airflow duct means defined by said annular groove.

18. A filter according to claim 16, wherein said annular groove has a floor surface which is impervious to air.

19. A filter according to claim 16, wherein said region of progressively decreasing depth transversely of said groove continues substantially to said mouth end of the filter plug means.

20. A tobacco smoking article including a smoke filter according to claim 16, and a tobacco rod abutting and coaxial with said smoke filter; wherein said sleeve overlies the whole of said filter plug means and at least part of said tobacco rod.

* * * * *